US005228822A

United States Patent [19]

Schrader

[11] Patent Number: 5,228,822

[45] Date of Patent: Jul. 20, 1993

[54] APPARATUS TO FACILITATE THE LIFTING AND DUMPING OF A REFUSE CONTAINER

[76] Inventor: William J. Schrader, W1442 Cleveland Ave., Marinette, Wis. 54143

[21] Appl. No.: 924,359

[22] Filed: Jul. 31, 1992

Related U.S. Application Data

[63] Continuation of Ser. No. 646,171, Jan. 28, 1991, abandoned.

[51] Int. Cl.[5] ..... B65F 3/02

[52] U.S. Cl. ..... 414/421; 414/408; 414/620; 414/729

[58] Field of Search ..... 414/403, 404, 406, 407, 414/408, 409, 421, 419, 422, 425, 620, 729; 294/94, 95, 101, 116

[56] References Cited

U.S. PATENT DOCUMENTS

| | | | |
|---|---|---|---|
| 3,217,913 | 11/1965 | Aldredge et al. | 414/408 |
| 3,894,642 | 7/1975 | Shive | 414/421 X |
| 4,295,776 | 10/1981 | Payne et al. | 414/421 X |
| 4,580,940 | 4/1986 | Sheaves | 414/421 X |
| 4,673,327 | 6/1987 | Knapp | 414/408 |
| 4,773,812 | 9/1988 | Bayne et al. | 414/408 |
| 5,024,573 | 6/1991 | Redding et al. | 414/408 |
| 5,026,241 | 6/1991 | Wyman | 414/421 X |

FOREIGN PATENT DOCUMENTS

| | | | |
|---|---|---|---|
| 537947 | 2/1977 | U.S.S.R. | 414/620 |
| 1335530 | 9/1987 | U.S.S.R. | 414/421 |

*Primary Examiner*—Frank E. Werner
*Attorney, Agent, or Firm*—Douglas B. White

[57] ABSTRACT

This invention relates to an apparatus which is adapted to a common front-loader. This apparatus includes a rotatable refuse container engaging frame having a cam actuated hooking device to grasp cross bars mounted on the refuse container. Additionally, a fluid pressure actuated rotator is employed to cause rotation of the engaging frame and to thereby dump the container.

2 Claims, 2 Drawing Sheets

APPARATUS TO FACILITATE THE LIFTING AND DUMPING OF A REFUSE CONTAINER

This is a continuation of application Ser. No. 07/646,171 filed Jan. 28, 1991, now abandoned.

BACKGROUND OF THE INVENTION

1. Field of the Invention

The present invention relates generally to apparatus for lifting and dumping of containers. More particularly, this invention is directed towards apparatus adapted to engage, lift, and dump commonly used refuse containers.

2. Description of the Prior Art

It has been known in the material handling industry to provide lifting and tilting mechanisms. An example of such an apparatus is presented in U.S. Pat. No. 4,797,050 which describes a machine designed to grasp, lift and then rotate, to pour liquid filled drums.

In the construction and demolition industries rectangular refuse containers are typically used to collect debris and these are then dumped into hauling trucks by means of mechanisms mounted on the trucks. In practice, however, it is frequently desirable to first collect the debris in a container and then to dump the container into a chute or bin. This often occurs when the container is on an upper floor and it is desirable to dump the contents into a chute instead of hauling the container down to ground level and then back to the floor. Prior to this invention no apparatus has been proposed which will efficiently grasp the container, lift and move it, and then rotate the container to dump the contents.

SUMMARY OF THE INVENTION

Generally there is provided herein an apparatus which is adapted to a common front-loader. This apparatus includes a rotatable refuse container engaging frame having a cam actuated hooking device to grasp cross bars mounted on the refuse container. Additionally, a fluid pressure actuated rotator is employed to cause rotation of the engaging frame and to thereby dump the container.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
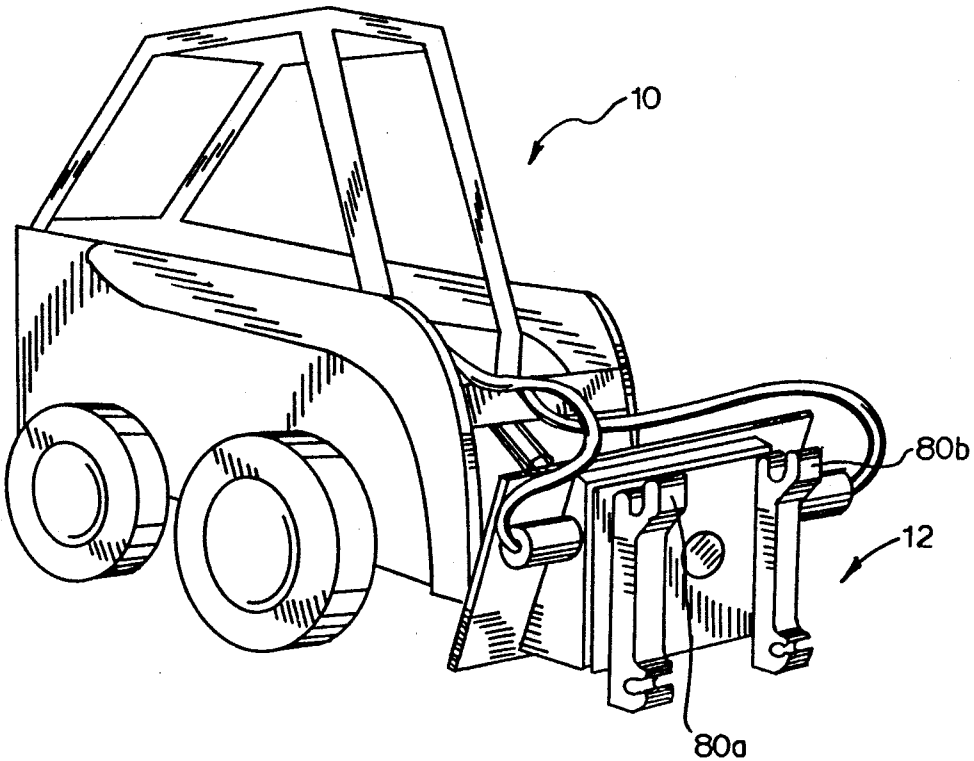
FIG. 1 is a perspective view of a front loader vehicle employing the apparatus of the present invention.

Turning first to FIG. 1 there is shown a vehicle 10 fitted with apparatus 12 in accordance with the present invention for engaging, lifting and turning a dumpster

14. This vehicle is typically of a front loader type to facilitate the lifting and transport of the dumpster. However, the apparatus of the present invention may be fitted onto fork lifts or other similar machines where lift and mobility functions are provided. Generally this involves mounting of the apparatus to the lift element of the machine in accordance with customary techniques and then an operational fluid line 16*a* and 16*b* is connected from the apparatus to the pressurized fluidic system of the machine.

Figure 2:
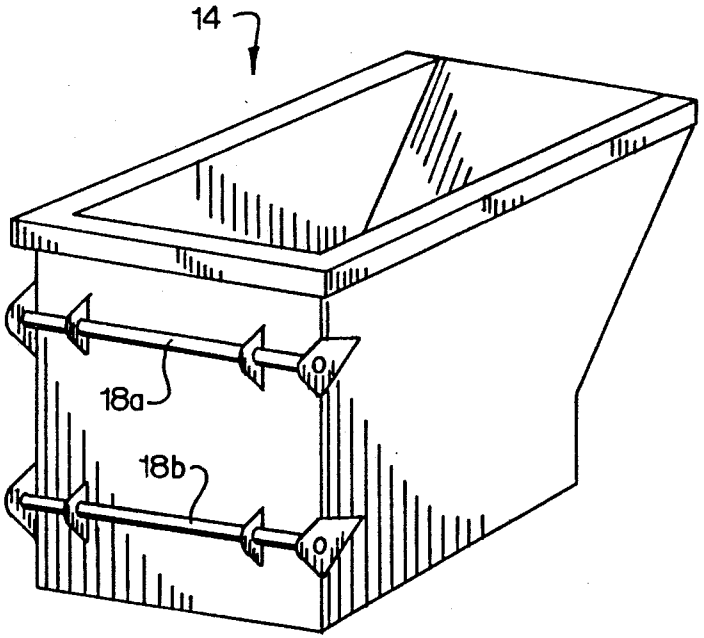
FIG. 2 is a perspective view of a dumpster modified for engagement with the apparatus of the present invention.

The dumpster employed with the present invention (FIG. 2) is typically of a rectangular construction, although any shape may be used. This dumpster is fitted with upper and lower engagement bars 18*a* and 18*b* to facilitate the lifting and then the turning of the dumpster. The apparatus 12 grasps these engagement bars and secures the dumpster during operation.

Figure 4:
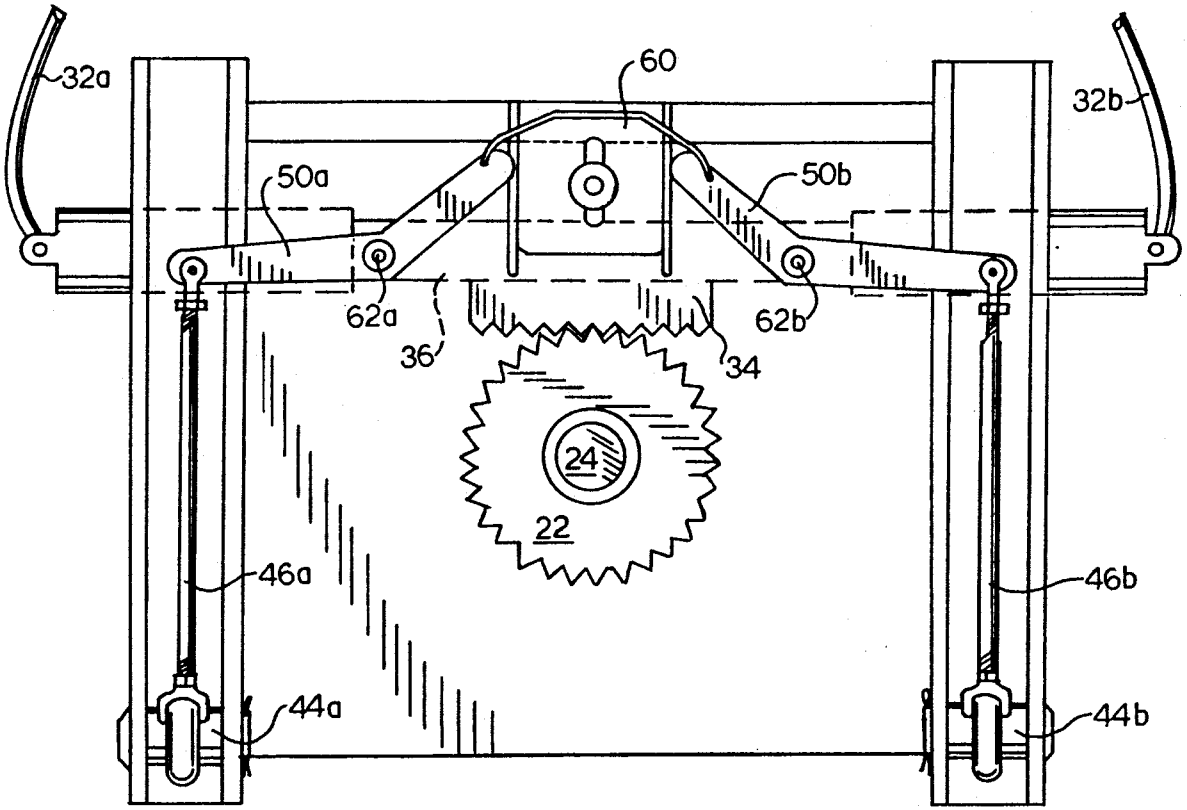
FIG. 4 is a partially cut away rear view of the rotating engaging portion of the apparatus of the present invention.
Figure 3:
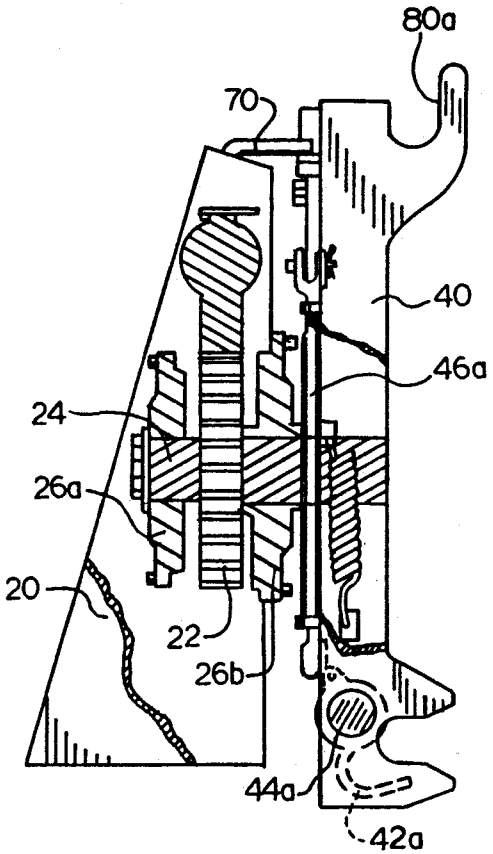
FIG. 3 is a cross section view of the apparatus of the present invention.

The apparatus of the present invention and its operation may now be best understood by reference to FIGS. 3 and 4. The apparatus housing 20 encloses a rotational gear 22 mounted to a forwardly directed shaft 24, the axis of this shaft being orthogonal to the lifting direction. This shaft is carried on bearings 26*a* and 26*b* affixed to the housing. Fluidically operated cylinders 30*a* and 30*b* are connected via pressure lines 32*a* and 32*b* to operational valves on the lift vehicle. When actuated, the fluidic pressure from the vehicle acts to drive these cylinders in tandem reciprocal motion. A straight gear 34 is fixed to the common reciprocating cylinder piston 36 and works to turn the rotational gear 22 when the cylinders are actuated.

The forwardly directed shaft 24 attaches at its forward extremity to the dumpster engaging frame member 40, to rotate the engaging structure and the dumpster grasped thereby. For engaging the dumpster, lower locking hooks 42*a* and 42*b* are arranged to pivot on axes 44*a* and 44*b* and are caused to pivot thereabout by controlling arms mounted within the frame member for reciprocal motion and 46*a* and 46*b*. The controlling arms are biased by springs 48*a* and 48*b* in a downwardly direction to maintain the hook in a closed position unless pulled into the open position shown. When in the closed position, the lower hooks interlock with recesses in the frame member.

Positioning of the controlling arms is provided through pivot arms 50*a* and 50*b* which are connected at one extremity to a controlling arm and at their other extremity to a reciprocating cam 60. Accordingly, downward pressure on the cam 60 rotates the pivot arms about their axes 62*a* and 62*b*, pulling the control arms upwardly, and opening the lower hooks. When the engaging structure is in its upright position a cam depressing arm 70 (FIG. 3) projecting from the housing 20 pushes the reciprocating cam downwardly to open the lower hooks. As the engaging structure is rotated, following actuation of the cylinders, the cam moves away from the depressing arm. This allows the cam to rise under the spring bias and the hooks pivot into the closed locking position. Consequently, once rotation begins the container is securely locked into position.

To use the apparatus of the invention, the housing 20 is fitted to a lift vehicle and the fluidic control lines 32*a* and 32*b* are connected via a control valve (not shown) to the fluid power of the vehicle. The engagement bars 18*a* and 18*b* are also added to dumpsters which will be handled with the apparatus. The apparatus is then moved into engagement with a dumpster, with the upper catch-hooks 80*a* and 80*b* engaging the upper bar on the dumpster and the lower pivoting hooks (unclosed) engaging the lower bar. In this position the dumpster may be lifted and transported to a dump site.

When the dumpster is positioned in the desired dump location, the fluidic control valve is used to actuate the cylinders and to cause the engaging structure 40 to rotate. As it starts to rotate the spring bias on the lower pivoting hooks causes them to close and to thereby secure the dumpster. Further rotation allows the contents of the dumpster to exit to the desired chute or bin. Counter rotation of the engaging structure returns the dumpster to an upright position and automatically unlocks the lower pivoting hooks.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Apparatus for attachment to a vehicle to rotate a refuse container, said container having upper and lower bar members mounted thereon, said apparatus comprising:

lifting means mounted to said vehicle for lifting the container;

a housing for attachment to said lifting means having mounted therein selectively operable fluidically powered piston means for driving the piston thereof in reciprocal motion;

a linear gear affixed to said piston and positioned to engage a rotational gear for rotating a drive shaft thereby, wherein the axis of rotation of said drive shaft is orthogonal to the lifting direction of said lifting means; and container engaging means including a frame member mounted to said drive shaft for rotation therewith and including control arms mounted within said frame member for providing reciprocal control motion, said frame member having upper hooks protruding from an upper portion thereof for engaging the upper bar member of the refuse container, and pivotally mounted lower hooks protruding from the lower portion of said frame member, wherein said lower hooks are caused to pivot about an axis orthogonal to said drive shaft axis in response to said motion of said control arms to thereby interlock with recesses defined in said frame member and thereby engage said lower bar member of the refuse container.

2. The apparatus for attachment to a vehicle of claim 1 wherein said control arms are caused to move in response to cam actuation to maintain said lower hooks in an open position when said frame member is unrotated but to cause said lower hooks to interlock with said recesses when said frame member is rotated.

* * * * *